US011022410B2

(12) United States Patent
Lumley

(10) Patent No.: US 11,022,410 B2
(45) Date of Patent: Jun. 1, 2021

(54) SHAPED CHARGE LINER METHOD AND APPARATUS

(71) Applicant: JET PHYSICS LIMITED, Alston (GB)

(72) Inventor: Andrew Lumley, Alston (GB)

(73) Assignee: JET PHYSICS LIMITED, Alston (GB)

( * ) Notice: Subject to any disclaimer, the term of this patent is extended or adjusted under 35 U.S.C. 154(b) by 304 days.

(21) Appl. No.: 16/056,105

(22) Filed: Aug. 6, 2018

(65) Prior Publication Data

US 2019/0093995 A1 Mar. 28, 2019

Related U.S. Application Data

(63) Continuation of application No. 15/855,688, filed on Dec. 27, 2017, now abandoned, which is a (Continued)

(30) Foreign Application Priority Data

Jan. 18, 2010 (GB) ..... 1000849

(51) Int. Cl.
*F42B 1/032* (2006.01)
*F42B 1/028* (2006.01)
*F42B 3/08* (2006.01)

(52) U.S. Cl.
CPC ..... *F42B 1/032* (2013.01); *F42B 1/028* (2013.01); *F42B 3/08* (2013.01)

(58) Field of Classification Search
CPC .. F42B 1/02; F42B 1/028; F42B 1/032; F42B 3/08
See application file for complete search history.

(56) References Cited

U.S. PATENT DOCUMENTS 2,543,057 A * 2/1951 Porter ..... F42B 1/02 102/307
3,165,057 A * 1/1965 Armstrong ..... F42B 1/02 102/307

(Continued)

FOREIGN PATENT DOCUMENTS

AU 2003283125 B2 6/2004
EP 1241433 A2 9/2002

(Continued)

OTHER PUBLICATIONS

Advanced Cutting Explosive published by Ensign-Bickford Aerospace & Defense Company, 2003.

(Continued)

*Primary Examiner* — Gabriel J. Klein
(74) *Attorney, Agent, or Firm* — EIP US LLP

(57) ABSTRACT

One or more aspects of the present disclosure relate to a method of at least partly manufacturing a liner for a linear shaped charge. The method can include coating each of a plurality of metal particles with a non-metal, to form a plurality of coated spherical particles; mixing, without a solvent, the plurality of coated spherical particles with a polymer binder and at least one of: a filler, a dry lubricant, or a wet lubricant, until a flexible material is formed with the plurality of coated spherical particles dispersed homogeneously in the polymer binder and the flexible material has a mass of at least 5,700 kg per cubic meter volume of the flexible material; and at least partly forming a liner for the linear shaped charge from the flexible material.

22 Claims, 5 Drawing Sheets

Related U.S. Application Data continuation of application No. 13/552,238, filed on Jul. 18, 2012, now abandoned, which is a continuation of application No. PCT/GB2011/000063, filed on Jan. 18, 2011.

(56) References Cited

U.S. PATENT DOCUMENTS

| | | | | | |
|---|---|---|---|---|---|
| 3,185,089 | A * | 5/1965 | Parkhurst | F42B 3/093 | 102/307 |
| 3,855,929 | A | 12/1974 | Ridgeway | | |
| 3,935,340 | A * | 1/1976 | Yamaguchi | B22F 1/02 | 427/216 |
| 4,151,798 | A | 5/1979 | Ridgeway | | |
| 4,693,181 | A * | 9/1987 | Dadley | F42B 1/032 | 102/307 |
| 4,905,601 | A * | 3/1990 | Gabriel | F42B 3/08 | 102/302 |
| 4,958,569 | A * | 9/1990 | Mandigo | F42B 1/032 | 102/476 |
| 5,331,895 | A * | 7/1994 | Bourne | F42B 1/032 | 102/307 |
| 6,012,392 | A * | 1/2000 | Norman | B22F 3/16 | 102/307 |
| 6,371,219 | B1 * | 4/2002 | Collins | E21B 43/117 | 102/311 |
| 6,378,438 | B1 | 4/2002 | Lussier | | |
| 6,588,344 | B2 * | 7/2003 | Clark | F42B 1/032 | 102/306 |
| 6,962,634 | B2 * | 11/2005 | Nielson | C06B 27/00 | 102/306 |
| 7,536,956 | B2 | 5/2009 | Sammons | | |
| 8,904,934 | B1 * | 12/2014 | Scheid | F42B 3/08 | 102/307 |
| 10,704,867 | B2 * | 7/2020 | Church | F42B 1/032 | |
| 2006/0201373 | A1 * | 9/2006 | Sammons | F42B 3/08 | 102/476 |
| 2007/0051267 | A1 * | 3/2007 | Meddes | F42B 3/28 | 102/307 |
| 2009/0169888 | A1 * | 7/2009 | Kikuhara | C22C 1/045 | 428/402 |
| 2013/0327571 | A1 * | 12/2013 | Andrzejak | F42B 1/032 | 175/2 |

FOREIGN PATENT DOCUMENTS

| | | | |
|---|---|---|---|
| EP | 1757896 | A1 | 2/2007 |
| GB | 618617 | A | 2/1949 |
| GB | 2165868 | A | 4/1986 |
| GB | 2176878 | A2 | 1/1987 |
| GB | 2179664 | | 3/1987 |

OTHER PUBLICATIONS

Ashton, "Navy Experimental Diving Unit Report 15-90", United States Department of the Navy, May 1990, 25 pages.

BLADE the Cutting Edge, Royal Ordnance Industrial Energetics, Jan. 1994, 4 pages.

Linear Shaped Charge, Space-Ordnance Division, Ensign Bickford, Jun. 1967, 40 pages.

NAX Product Lines, North American Explosives, 1989, 2 pages.

Technical Manual Demolition Materials, The United States Navy Sea Systems Command, Sep. 1, 1989, 4 pages.

Vigil, "Optimized Conical Shaped Charge Design using the SCAP Code", Sandia Report, Sep. 1988, pp. 1-87.

Vigil, "Precision Linear Shaped Charge Designs for Severance of Aluminum materials", Sandia Report, Dec. 1992, 35 pages.

Walters, "Introduction to Shaped Charges", Army Research Laboratory, Mar. 2007, 124 pages.

International Search Report for PCT/GB2011/000063 dated Dec. 23, 2011.

Written Opinion for PCT/GB2011/000063 dated Feb. 6, 2012.

Great Britain Search Report for GB 1000849.8 dated May 14, 2010.

* cited by examiner

SHAPED CHARGE LINER METHOD AND APPARATUS

CROSS-REFERENCE TO RELATED APPLICATIONS

This application is a continuation under 35 U.S.C. § 120 of U.S. application Ser. No. 15/855,688, filed Dec. 27, 2017, which is a continuation of 35 U.S.C. § 120 of U.S. application Ser. No. 13/552,238, filed Jul. 18, 2012, which is a continuation of International Application No. PCT/GB2011/000063, filed Jan. 18, 2011, which claims priority to Great Britain App. No. 1000849.8, filed Jan. 18, 2010. The entire contents of which are incorporated herein by reference in their entirety.

BACKGROUND

Field of the Disclosure

The present disclosure relates to a material and a shaped charge, particularly but not exclusively a linear shaped charge, comprising the material, and an element for a shaped charge.

Description of the Related Technology

A linear cutting charge is an explosive device for cutting a target object.

A type of linear cutting charge is termed a linear shaped charge. Linear shaped charges are known from the prior art, for example from U.S. Pat. No. 4,693,181, and the product commercially known as "Blade"® generic charge, demolition, linear, cutting/flexible, lightweight (CDLC/FL) In use, a linear shaped charge is applied to a target object for cutting. Upon detonation of an explosive element in the charge, a metal liner forms a metal slug which is projected as a cutting jet towards the target object. The cutting jet is linear, along a longitudinal axis of the charge, and therefore cuts the target object along a line defined by a configuration of the charge when applied to the target object. This may be a curved linear configuration. The shape and depth of the cut may be finely controlled, by selecting appropriate dimensions and explosive loadings in the charge. Accordingly, linear shaped charges have many and varied applications, both civil and military, where a clean and controlled cut is required. Given the high cutting power, linear shaped charges may be used to cut concrete or metallic structures, for example when breaching walls or demolishing building structures. The precision of the line and depth of the cut allows for delicate cutting operations, for example cutting of a bomb casing.

Other types of shaped charges are known, for example a conical shaped charge as described in European patent no. EP 1241433 B1.

Known linear shaped charges provide a cutting jet with a limited efficiency. Further, the cutting jet may lack homogeneity, leading to fragmentation of the jet and consequently cutting of a target object with reduced precision and efficiency, and less reliable severance.

It is an object of the present disclosure to overcome these disadvantages.

SUMMARY

In accordance with one aspect of the present disclosure, there is provided a material comprising particles dispersed in a polymer matrix, wherein the particles include at least one metal and are packed in the polymer matrix with a density of at least 0.6 of the density of the at least one metal.

The material of the present disclosure advantageously has a high density of particles in the polymer matrix. Such a material has numerous applications. For example, in some embodiments, a liner of a linear shaped charge, for example a flexible linear shaped charge, may be formed of the material. Such a liner formed of the material of the disclosure provides a cutting jet with an improved efficiency for a given amount of explosive in the charge. Moreover, the homogeneity of the jet is improved, reducing fragmentation of the jet when projected towards a target object when explosive in the charge is detonated. This provides a more precise, and therefore efficient, cut, giving a reliable target severance for a given explosive mass of the explosive element.

Using a liner comprising a density of the particles of at least 0.6, in a linear shaped charge, does not require modification of dimensions of components of the charge compared with known linear shaped charges. Such dimensions include an apex angle, a stand-off distance and an explosive distribution, which are explained in further detail below. Surprisingly, the material of the disclosure allows a liner to provide a cutting jet with a greater cutting efficiency without increasing a thickness of the liner, or an explosive loading in the charge.

In accordance with some embodiments of the disclosure, the particles are packed in the polymer matrix with a density of at least 0.625, 0.650, 0.675, or 0.700 of the density of the at least one metal. With such particle densities, a liner formed of the material may provide an even more efficient and homogenous cutting jet, due to an increased density of the particles in the cutting jet. Thus, there is energy coupling between the explosive element upon detonation to the target, via the cutting jet.

In further embodiments of the present disclosure, the particles are substantially spherical. This allows efficient packing of the particles in the polymer matrix; thus the particle density of at least 0.6 of the density of the at least one metal, or greater, may be achieved. Moreover, the substantially spherical shape of the particles aids flow of the particles in the jet, thus improving homogeneity of the jet and therefore efficiency of cutting. The term substantially spherical means the average shape of the particles is spherical; in other words greater than 50%, optionally 70% or 90%, of the particles in the material are spherical.

In further embodiments of the disclosure, the particles comprise particles with different diameters. A mixture of particles with different diameters improves packing efficiency of the particles with each other within the polymer matrix. For example, particles of a smaller diameter pack between particles of a larger diameter.

In an embodiment of the present disclosure, the particles include: 0.5 to 1 wt % particles with a diameter of 70 micro-meters; 4 to 5 wt % particles with a diameter of 60 micro-meters; 20 to 30 wt % particles with a diameter of 50 micro-meters; 25 to 35 wt % particles with a diameter of 40 micro-meters; 20 to 30 wt % particles with a diameter of 10 micro-meters; and less than 3 wt % particles with a diameter of less than 10 micro-meters.

Thus, the total number of particles in the polymer matrix is formed of groups of particles of different diameters. The term wt % refers to a percentage by weight of the total weight of particles in the material. The quantities of particles with the selected diameters in this embodiment yield a density of particle packing in the material in accordance with the disclosure. Further, a liner comprising the material of this embodiment yields a particularly efficient and homogenous jet.

In further embodiments of the disclosure, the at least one metal is selected from the group consisting of: Cu, W, Mo, Al, U, Ta, Pb, Sn, Cd, Co, Mg, Ti, Zn, Zr, Be, Ni, Ag, Au, Pt, and/or an alloy thereof. The particles in the material may be all of one metal or alloy of metals, or a mixture of different metals and/or alloy.

In an embodiment the at least one metal comprises Cu. Depending on the packing density of particles, the material may in accordance with the disclosure have a density greater than 5,000, 5,100, 5,200, 5,300, 5,400, 5,500, 5,600, or 5,700 kg $m^{-3}$. In an embodiment at least for forming a liner of a shaped cutting charge, for providing a highly efficient and homogeneous jet, the material has a density of substantially 5,800 kg $m^{-3}$. Substantially 5,800 kg $m^{-3}$ means the mean density of the material throughout its volume is 5,800 kg $m^{-3}$.

In other embodiments, the polymer matrix comprises polybutene and/or polyisobutylene, and/or at least one compound selected from the group consisting of: polytetrafluoroethylene, di-2-ethylhexyl sebacate, cyanuric acid, melamine, boron nitride, di-n-octyl phthalate, silicone, latex, alginate copolymer, methacrylate resin, vegetable oil. Further details are explained below.

In some embodiments, the particles are substantially uniformly dispersed in the polymer matrix, neighboring particles being separated from each other by polymer. Substantially uniformly means that a mean separation distance between neighboring particles in a first volume, and in a different second volume of the material, are equal. With a packing density of 0.7, for example, the neighboring particles may be separated from each other by polymer, meaning that the particles are dispersed homogenously in the polymer. This improves a homogeneity of the jet when a liner is formed of the material, thus improving cutting efficiency. Further, polymer separation of the particles avoids particle to particle contact, which can reduce storage lifetime of the material.

In embodiments of the present disclosure the material of the disclosure may be flexible. The term flexible used herein in respect of the material means that the configuration of the material may be changed between different configurations, for example from a first configuration to a second, different, configuration. That is to say the material is not rigid. With the material being flexible, a shaped charge including a liner formed of the material may be rendered flexible. Further, the material may be non-resilient, meaning that the material does not restore itself from for example the second configuration to the first configuration.

In a further aspect of the present disclosure, there is provided a linear shaped charge comprising an explosive element, a liner, a face for application to a target object and a space between the liner and the face, the liner comprising a material in accordance with embodiments of the present disclosure. The liner being formed of the material provides an efficient and homogeneous cutting jet, as explained above.

In another aspect of the present disclosure, there is provided a shaped charge comprising an explosive element, a liner, a face for application to a target object and a space between the liner and the face, the liner comprising a material in accordance with the present disclosure. The material of the present disclosure may therefore be used in other types of shaped charge.

According to yet another aspect of the present disclosure, there is provided an element for forming a liner of a shaped charge, the element being configurable between different configurations including a first configuration and a second configuration, wherein the first configuration is a pre-liner configuration arranged to be changed to the second configuration which is a liner for a shaped charge. This aspect allows a liner for a shaped charge to be formed on demand, for example in situ, when a shaped charge is required.

In embodiments of this yet another aspect, the element may comprise the material of the present disclosure. Thus, the liner formed from the first configuration, and therefore a shaped charge comprising the liner, has advantages provided by the material of the present disclosure.

In further embodiments, the element may be formed of a flexible and optionally elastic material. The flexibility facilitates changing of the element between different configurations, for example from the first configuration to the second configuration. The optional elasticity provides for a configuration of the element to be memorized, enabling improved configuring of the element to the second configuration, as explained below.

In other embodiments, the first configuration has a form for a person to change the element from the first configuration to the second configuration using their hands. Thus, a user requiring a shaped charge on demand, for example a demolitions engineer on-site within a confined space, can form a liner for a shaped charge from the element easily, without the need for bulky machines or tools. Indeed, the user may change the element to form the second configuration using solely their hands, or perhaps with the aid of simple and compact tools, suitable for carrying in a man-portable container, for example In other embodiments of the yet another aspect, the first configuration has a first part covered with a protective element. For example, the protective element may be arranged to prevent the first part from touching a second part of the first configuration. Otherwise, without the protective element, and depending on the material the element is formed of, the first and second parts may adhere to each other upon contact, which may hinder changing of the element from the first configuration to the second configuration.

In further embodiments, the first configuration is obtained by changing the element from a packed configuration. Thus, the element may be packed in a more compact form than the first configuration, the packed configuration being appropriate for being packed, for example in a man-portable container. The packed configuration may for example comprise the first configuration in a rolled configuration.

In another aspect of the present disclosure there is provided a kit for assembling a shaped charge, said kit comprising: an element in accordance with the element described above; and an explosive material suitable for application to the element for forming a liner of a shaped charge, when in the second configuration, to form a shaped charge. This allows a shaped charge to be packed in a compact form and assembled on demand.

In further embodiments, the kit comprises at least one structure, and/or material for forming at least one structure, arranged to provide a desired stand-off distance between a face of the shaped charge when assembled and a target object.

In other embodiments of the disclosure, the material of the disclosure may be used to reduce fouling of boat hulls by micro-organisms; the material may be applied to a boat hull, or provided in an anti-fouling paint for application to a hull.

Further features of the disclosure will become apparent from the following description of embodiments of the disclosure, given by way of example only, which is made with reference to the accompanying drawings.

DETAILED DESCRIPTION

Figure 1:
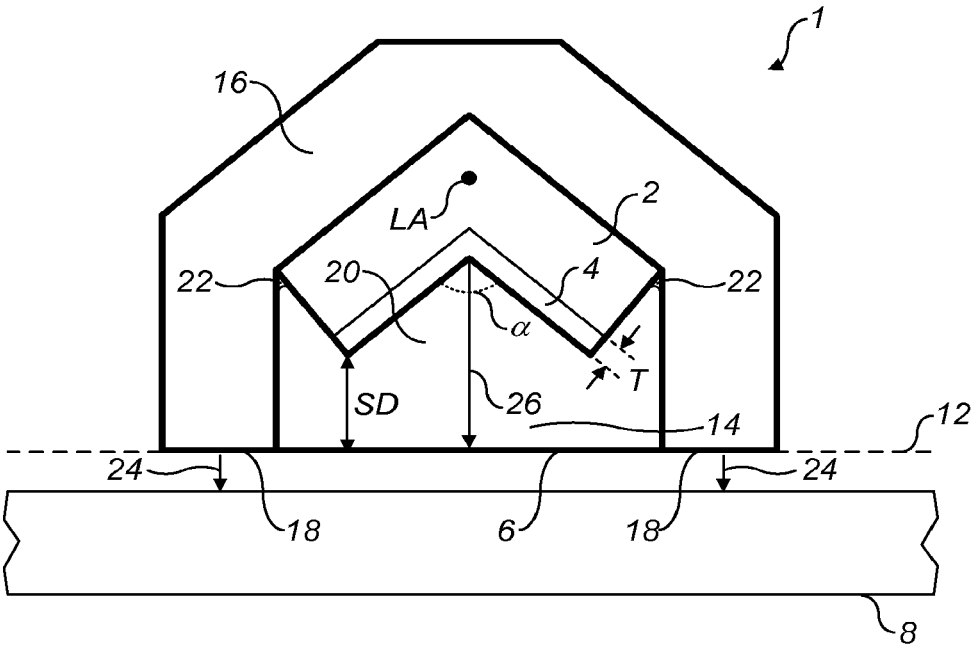
FIG. 1 shows schematically a cross section of an embodiment of the present disclosure.

The present disclosure relates to a material comprising particles dispersed in a polymer matrix, wherein the particles include at least one metal and are packed in the polymer matrix with a density of at least 0.6 of the density of the at least one metal.

In a specific embodiment of the present disclosure, the particles are copper (Cu) particles which are substantially spherical. The particles are packed in the polymer matrix with a density of 0.700 of the density of the at least one metal. Thus, the packing corresponds with the Kepler Conjecture on packing. The particles are substantially uniformly dispersed in the polymer matrix, with neighboring particles being separated from each other by polymer. The material has a density of substantially 5,800 kg m−3. Further, the particles comprise particles with different diameters, specifically: 0.5 to 1 wt % particles with a diameter of 70 micro-meters; 4 to 5 wt % particles with a diameter of 60 micro-meters; 20 to 30 wt % particles with a diameter of 50 micro-meters; 25 to 35 wt % particles with a diameter of 40 micro-meters; 20 to 30 wt % particles with a diameter of 10 micro-meters; and less than 3 wt % particles with a diameter of less than 10 micro-meters. The term wt % used for the ranges of copper particle size refers to a percentage weight of the total mass of copper particles in the material. The copper particles are 88 wt % of the total weight of the material. The copper particles are obtainable from ECKA Granulate GmbH & Co. KG, Frankenstraße 12 D-90762 Fürth, Germany.

The polymer matrix is flexible, defined above, and therefore the material provides flexible properties of the material. The polymer matrix comprises polyisobutylene (PIB) or polybutene (PB) which is 4.5 wt % of the total weight of the material. The PIB is for example Oppanol® B10, B12, B15 or B30 supplied by BASF, Ludwigshafen, Ohio 67063, Germany. The polymer matrix further comprises boron nitride, or a polytetrafluoroethylene dry lubricant, which is 4.5 wt % of the total weight of the material. Such a dry lubricant is obtainable as h-BN from Goodfellow Limited, Huntingdon, Cambridgeshire PE29 6WR, UK or Fluon® FL1690 or FL1710 from AGC Chemicals Europe, Ltd, Thornton Cleveleys, Lancashire FY5 4QD, UK.

Further, the polymer matrix comprises cyanuric acid or melamine, or polytetrafluoroethylene filler (including environmentally friendly "E" grades) which is 1.5 wt % of the total weight of the material. Cyanuric acid and melamine are obtainable from Monsanto UK Limited, Cambridge CB1 0LD, UK and ICI Akzo Nobel Powder Coatings Ltd., Gateshead, Tyne & Wear NE10 0JY, UK. Polytetrafluoroethylene filler is obtainable as CD123, CD127 or CD141 from Asahi Glass AGC Chemicals Europe Limited, Thornton Cleveleys, Lancashire FY5 4QD, UK.

Di-2-ethylhexyl sebacate (dioctyl sebacate—DOS) or di-n-octyl phthalate (DOP) plasticizer/wet lubricant is also added, as 1.5 wt % of the total weight of the material. Either may be obtained from Brad-Chem Ltd, Moss Ind. Estate. Leigh, Lancashire WN7 3PT, UK. Vegetable and other synthetic oil lubricants of diester type can be substituted as a plasticizer.

The material of this embodiment may be made in accordance with one of the following two methods:

In the first method, which yields approximately 10 kg material, a two-phase system is used consisting of an aqueous liquid phase and a second liquid phase which comprises an organic solvent that is insoluble in water carrying the polyisobutene binder: The polyisobutene binder is dissolved in a solvent of toluene to prepare a solution, which then is injected into the metal powder and filler and dry lubricant mix dispersed in water. A granular product is formed from the obtained mixture; this is then distilled to isolate the bulk polymer. This polymer may be calandered and slit to produce the required sectional dimensions for a liner of a linear shaped charge.

Specific process steps are now explained:

8.80 kg of particle blend with the different diameters described above and 0.60 kg filler and dry lubricant mixture (0.45 kg h-BN, FL1690 or FL1710 dry lubricant and 0.15 kg cyanuric acid, melamine, CD123, CD127 or CD141 dispersion filler) are put into a glass bead mill with stirrer and a capacity of approx. 20 liters.

After stirring for 20 minutes at room temperature, the mix is deagglomerated and thoroughly wetted by water. The suspension is then flushed out of the mill, separated from the glass beads and put into an agitator vessel.

With moderate stiffing, a solution of 0.45 kg of polyisobutene (BASF Oppanol B10, B12, B15 or B30) in a solvent mixture of 5 liters of toluene is then injected in the course of 20 minutes at room temperature into the wetted mix at ii) above.

The rate of stiffing is so controlled that spherical granulate consisting of metal, filler, dry lubricant and solvent is obtained after stiffing has been continued for 20 minutes at room temperature.

The granulate is separated from the water by suction filtration without mechanical action on the filter product. The filtration proceeds very easily on account of the solvent still present in the granulate. The granulate is subsequently freed from solvent by distillation and dried in a vacuum cabinet at 60° C.

Calandering and Slitting follows using a stainless steel two roll calander. The bulk polymer is passed through up to six times, reducing the nip by 5% on each pass to reduce the sectional thickness and increase density until material with the required sectional dimensions for the liner is produced.

The addition of 0.15 kg of plasticizer/wet lubricant: Di-2-ethylhexyl sebacate (dioctyl sebacate—DOS) or di-n-octyl phthalate (DOP), or vegetable oil may be required during the calandering pre-mixing stage.

In the second method which yields approximately 10 kg material, the copper particles having the quantities of different diameters described above for this embodiment are mixed with the dry lubricant and dispersing filler with binder and plasticizer in a high shear mixer apparatus, then the resultant bulk polymer so produced is milled and calendared and slit to the required sectional dimensions for liner.

Specific process steps are now described:

i) Charge the mixer with 0.45 kg polyisobutene (BASF Oppanol B10, B12, B15 or B30) and 0.60 kg filler and dry lubricant mixture (0.45 kg h-BN, FL1690 or FL1710 dry lubricant and 0.15 kg cyanuric acid, melamine, CD123, CD127 or CD141 dispersion filler) and masticate until the mixture has visually blended. This should take 2 minutes with a maximum frictional heat of 90 degrees Centigrade in the mixer.

ii) Add 8.80 kg of the copper powder particle blend and 0.15 kg of the plasticizer/wet lubricant: Di-2-ethylhexyl sebacate (dioctyl sebacate—DOS) or di-n-octyl phthalate (DOP), or vegetable oil, and mix for a further 20 minutes.

iii) Slugs of material are made from four to five batches, by passing bulk polymer batches through a two roll mill up to four times. The color of the batches to be mixed together into a slug should be comparable so that no streaking occurs. Calandering and Slitting follows using a stainless steel two roll calander. The bulk polymer is passed through up to six times, reducing the nip by 5% on each pass to reduce the sectional thickness and increase density until material with the required sectional dimensions for liner is produced.

In alternative embodiments of the disclosure, the particles may be packed in the polymer matrix with a density of at least 0.625, 0.650, 0.675, or 0.700 of the density of the at least one metal. Further, the particles may be substantially spherical. In other embodiments, the particles may comprise particles with different diameters; in such embodiments, the particles may include different proportions of the same, or different, diameters compared with those described in the specific embodiment above. In further envisaged embodiments, the at least one metal of the particles may be selected from the group consisting of: copper (Cu), tungsten (W), molybdenum (Mo), aluminum (Al), uranium (U), tantalum (Ta), lead (Pb), tin (Sn), cadmium (Cd), cobalt (Co), magnesium (Mg), titanium (Ti), zinc (Zn), zirconium (Zr), beryllium (Be), nickel (Ni), silver (Ag), gold (Au), platinum (Pt), and/or an alloy thereof. In embodiments where the at least one metal comprises copper alone, the material may have a density greater than 5,000, 5,100, 5,200, 5,300, 5,400, 5,500, 5,600, or 5,700 kg m−3. In other embodiments, the particles may be substantially uniformly dispersed in the polymer matrix, neighboring particles being separated from each other by polymer.

In accordance with a further embodiment of the present disclosure, there is provided a linear shaped charge comprising an explosive element, a liner, a face for application to a target object and a space between the liner and the face, the liner comprising a material in accordance with the material of the present disclosure.

Figure 2:
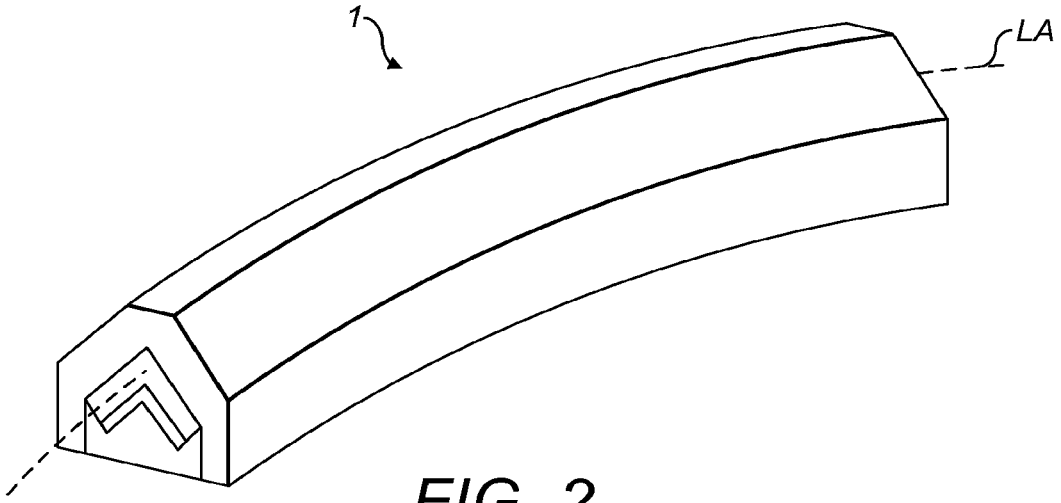
FIG. 2 shows schematically a perspective view of the embodiment of the present disclosure.

FIG. 1 shows schematically a cross section of a linear shaped charge 1 according to an embodiment of the present disclosure. FIG. 2 shows schematically a perspective view of the linear shaped charge 1 of this embodiment.

Referring to FIG. 1, the linear shaped charge comprises an explosive element 2, a liner 4, and a face 6 for application to a target object 8. The explosive element and the liner have a V-shaped cross section, taken in a plane perpendicular a longitudinal axis LA of the charge 1, as illustrated in FIG. 1. The liner lies in a groove of the V shaped cross section of the explosive element. The explosive element and the liner are formed of materials which adhere to each other upon contact, without requiring a separate adhesive. The face 6 is planar, defining a target plane 12. There is a space 14 between the liner 4 and the face 6.

In this embodiment, a casing 16 surrounds at least part of the explosive element 2. The casing 16 provides structural support to the charge 1, including to the explosive element and the liner during bending of the charge. The casing 16 also protects the explosive element and the liner from environmental factors such as rain, water vapor, and from being damaged if dropped or knocked.

The casing has a V-shaped surface which receives the explosive element 2 on a side opposite the side of the explosive element adhered to the liner 4. The casing 16 is arranged to determine a distance between the liner and the face, for example in this embodiment the casing 16 extends beyond a point of the liner nearest the face to define two longitudinal surfaces 18, parallel the longitudinal axis LA, lying in the plane 12 of the face 6. Thus, the casing has at least one part for application to the target object.

The liner is arranged for projection through the space, towards the face, when the explosive element is detonated. The extent of the casing 16 beyond the liner defines a stand-off distance SD between the extent of the liner nearest the face 6 and the plane 12 of the face 6. The stand-off distance SD is selected in accordance with dimensions of other components of the charge, for example a thickness T of the liner 4, and an apex angle □ of the liner 4. Thus, a form and cutting ability of a cutting jet formed by the liner when projected towards the face on detonating the explosive element 2 may be controlled.

The shape and volume of the space 14 is determined by the geometry of the explosive element 2, the liner 4 and the casing 16. A filling material 20 may fill substantially all of the space 14. The term substantially in this context means that more than 50% of the space is filled by the filling material. In the present embodiment all of the space is filled with the filling material, except for voids 22 formed to avoid feathering of edges of the filling material when being shaped. In other embodiments, greater than 75%, or greater than 90% of the space may be filled by the filling material. In another embodiment, 100% of the space is filled by the filling material. In alternative embodiments, at least part of the space may be filled with the filling material, for example less than 50% of the space. The filling material has a density of between 15 kg m−3 and 60 kg m−3, 25 to 60 kg m−3, 35 to 60 kg m−3, 45 to 60 kg m−3, 50 to 60 kg m−3 or 55 to 60 kg m−3; greater than 60 kg m−3 may obstruct the jet, thus decreasing the penetration of the cut into the target object. In other embodiments, the space may be empty; i.e. not filled.

In the present embodiment, the filling material 20 is fixed to parts of the casing 16 adjacent the filling material 20 with an adhesive; in alternative embodiments, the filling material and the casing may be integrally formed. In such embodiments, the casing and filling material press the explosive element against the casing and the liner against the filling material with sufficient pressure to fix the explosive element and liner in place in the charge 1. In alternative embodiments, with or without the filling material, the explosive element may be fixed to the casing with adhesive.

The filling material may not extend beyond the plane 12 of the face 6. In some embodiments, the filling material may have a face lying in the plane 12 of the face 6 of the charge, for application to the target object 8. The face 6 may comprise an adhesive layer (not shown) for adhering the charge 1 to the target object 8.

In use, the face 6 of the charge is applied to the target object 8, as indicated by arrows 24. The charge may be adhered or otherwise held in position on the target object. The charge 1 may be flexible along the longitudinal axis LA, by choosing appropriate materials of the component parts of the charge. Thus, the charge may be changed from a first configuration to a second, different, configuration. The flexibility means the charge may be applied in a curved configuration on the target object, for example with the face 6 of the charge on a planar surface of the target object, or with the face 6 following contours of a non-planar surface of the target object.

Once the charge 1 is applied to the target object, the explosive element 2 is detonated, using for example an electrical detonator. Upon detonation, the liner 4 is projected towards the target object 8 as a jet 26 originating from the apex of the liner 4. The jet 26 penetrates the target object along the length of the charge, thus cutting the target object 8.

The target object 8 illustrated in FIG. 1 is an example. A linear shaped charge according to the present disclosure may be used to cut many different objects, of various shapes with varying complexity, and formed of numerous different materials, organic and inorganic, for example metal, concrete, mineral, or plastic.

Examples of materials of components of a linear shaped charge described above in accordance with the disclosure will now be described.

The explosive element 2 comprises for example a mixture of 88% by weight of RDX (cyclotrimethylenetrinitramine), 8.4% by weight PIB (polyisobutylene), 2.4% by weight DEHS (2 (Diethylhexyl) sebacate), and 1.2% by weight PTFE (polytetrafluoroethylene), the % by weight being a percentage of the weight of the explosive element. Alternatively, the explosive element may comprise SX2/Demex Plastic Explosive from BAE Systems, Glascoed, USK, Monmouthshire NP15 1XL, UK, or Primasheet 2000 Plastic Explosive from Ensign-Bickford Aerospace & Defense Company, Simsbury, Conn. 06070 USA.

The liner comprises a material in accordance with the present disclosure, as described above.

The casing and the filling material comprise, for example, low density polyethylene foam, obtainable as Plastazote® from Zotefoams plc, 675 Mitcham Road, Croydon, Surrey CR9 3AL, Great Britain. The casing and/or the filling material may have a density in the range of 15 to 60 kg m−3, 25 to 60 kg m−3, 35 to 60 kg m−3, and may be between 45 to 60 kg m−3, 50 to 60 kg m−3 or 55 to 60 kg m−3 to give more structural support to the charge.

The casing and the filling material may be adhered to each other using for example 3M® Impact Vinyl Adhesive 1099 obtainable from 3M UK PLC, Jackson Street, Manchester M15 4PA, UK. The linear shaped charge may be attached to the target object using the adhesive, namely 3M® Impact Vinyl Adhesive 1099 from 3M UK PLC, Jackson Street, Manchester M15 4PA, UK.

The linear shaped charge may be manufactured by extruding the explosive element and the liner from the appropriate material. The casing and filling material may be manufactured by a suitable cutting or grinding process. The explosive element, liner, casing and filling material may then be assembled to form the charge, including adhering the casing to the filling material.

The above embodiments are to be understood as illustrative examples of the disclosure. Further embodiments of the disclosure are envisaged. For example, the material of the liner may be used in a liner of a conical, parabolic, hemispherical, and/or progressive shaped charge or other type of shaped charge. Further, for example, a material in accordance with the present disclosure is not limited for applications in a linear or other shaped charge, specifically as a liner. Further applications are envisaged, for example application of a material of the disclosure to boat hulls as an anti-fouling treatment; the material may be applied directly to a boat hull, and/or may be applied using a suitable adhesive, and/or may be formulated as a paint for coating a boat hull. In other embodiments, a boat hull may at least partly comprise a material in accordance with the present disclosure, thus providing a long term, possibly permanent, anti-fouling measure for a boat.

In the embodiments described above, the explosive element, the casing and the filling material may be formed of different materials from those described above. The liner may also comprise further compounds not described above, within the scope of the disclosure. For example, the polymer matrix may include silicone, a latex, an alginate copolymer, and/or light/laser curable methacrylate resin. Further, the configuration of the charge, the liner, explosive element, casing and filling material may be different from those described above and illustrated in the Figures. The particles may include one metal, or a plurality of metals. Further, the particles may include at least one non-metal in addition to at least one metal. In such embodiments, the particles including at least one metal and at least one non-metal may be substantially spherical; however the metal part of at least some of such particles may not be spherical, and may be irregular in shape. A non-metal material may be applied as a coating to each such non-spherical metal part, the non-metal then being rounded to produce a particle which is closer to being spherical, if not spherical. This rounding may be achieved by tumbling the particles with unpolished glass beads. In this way substantially spherical particles may be formed. The non-metal material may for example be the polytetrafluoroethylene (PTFE) filler referred to above and the metal may be copper. Such embodiments may have benefits, for example in terms of cost, since spherical metal particles may be more expensive than non-spherical metal shapes. Irregular shaped copper for such embodiments may be supplied by ECKA, referred to previously, and are of an appropriate size/mix of sizes for forming the material of the disclosure. The material according to these embodiments may comprise the same constituents, in the same wt % proportions, as those described previously except with the 88 wt % of substantially spherical copper particles being instead 88 wt % of irregular shaped copper, or 88 wt % of copper comprising both irregularly shaped copper and substantially spherical copper particles. The proportion of dry lubricant in the material may be reduced in accordance with the amount of non-metal used to coat the irregularly shaped copper. For example, where the non-metal for the particles is PTFE, this PTFE may be part of the 4.5 wt % PTFE in the material, compared with the earlier described example where 4.5 wt % of PTFE was used as dry lubricant. In the present embodiment, the material is formed for example by first forming the particles comprising metal and non-metal in the manner described above, using an appropriate amount of PTFE to coat the irregular shaped copper, and then forming the material using for example the method described previously using an appropriately reduced proportion of PTFE dry lubricant in view of the proportion of PTFE coating the irregular copper. A similar method is envisaged for forming the material where a different dry lubricant material is used, which may also be used as the non-metal for the particles.

In further envisaged embodiments, the particles of the material of the present disclosure may comprise a mixture of wholly metallic particles, for example the copper particles described previously, and particles including at least one non-metal and one metal, such as those described above comprising copper and PTFE filler. For such embodiments, the density of the material may be determined depending on the proportion of wholly metal particles and the proportion of particles comprising at least one non-metal and one metal.

Figure 3:
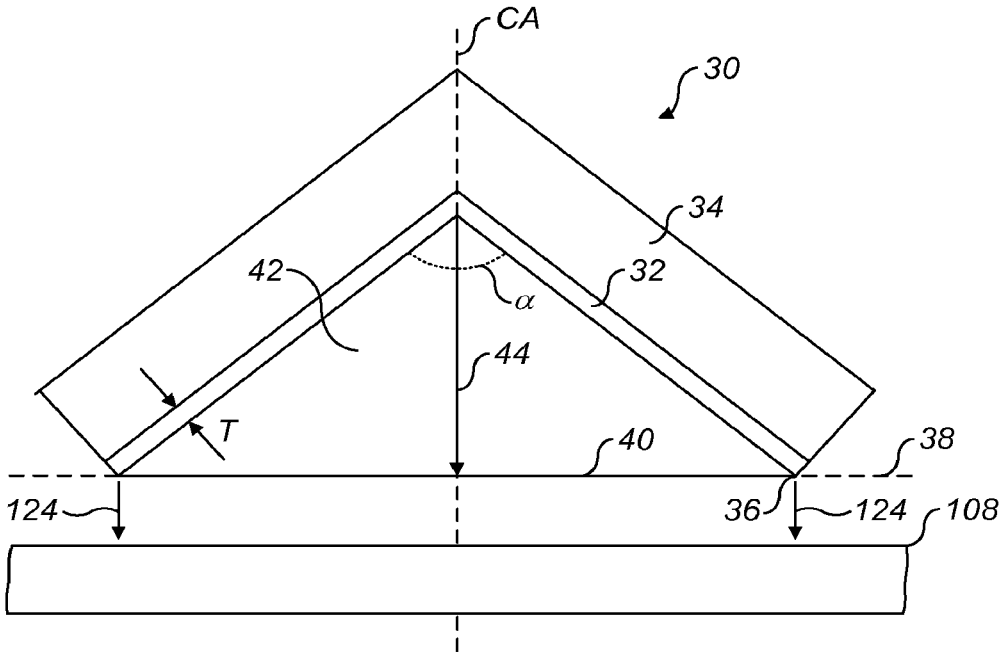
FIG. 3 shows schematically a cross section of a further embodiment of the present disclosure.

FIG. 3 illustrates an alternative configuration of a liner of a shaped charge. This liner is arranged for use in a conical shaped charge rather than a linear shaped charge. Examples of conical shaped charges are well known in the art. A problem with conical shaped charges is that they can be bulky. This means that, in use, for example for civil applications, storing and carrying one or multiple conical shaped charges, for example in a man-portable container, can be awkward and can occupy substantial packing space. Moreover, known conical shaped charges may be damaged, for example squashed or otherwise deformed, in transit. The liner described below with reference to FIG. 3 overcomes these problems.

FIG. 3 illustrates schematically, in cross section, an example of a conical shaped charge 30 comprising the alternative configuration of liner. Some features of the conical shaped charge 30 are similar to features described previously for the linear shaped charge; such features are labelled with the same reference numeral incremented by 100 and corresponding descriptions should be taken to apply here also.

The conical shaped charge 30 comprises a conical shaped liner 32 which is explained in further detail below. The conical liner 32 is received by a conical shaped explosive element 34. In cross-section, the conical liner 32 has a V-shape, as illustrated. At the open end of the V-shaped conical liner, the liner 32 forms a circular edge 36 for application to a target object intended for penetration by a jet formed when the explosive element of the conical shaped charge is detonated. The circular edge 36 lies in a plane which defines a target plane 38, and therefore defines a face 40 of the conical shaped charge for application (see arrows 124) to a target object 108. Between the liner 32 and the face 40 is a space 42 which in further examples may optionally be substantially filled with filling material (not indicated) such as that described previously in relation to FIG. 1. Alternatively, the space 42 may not be filled.

In this example, the liner is formed from an element which is configurable between different configurations including a first configuration and a second configuration, the first configuration being a pre-liner configuration arranged to be changed to a second configuration which is a liner for a shaped charge. The element for forming the liner and therefore the liner 32 may be formed of a flexible material, in accordance with the definition of the term flexible given previously. This allows the shape of the element to be changed from the first configuration to the second configuration, for example. The element for forming the liner may be formed of a material in accordance with the present disclosure. Or, the element for the liner may be formed of a different material with sufficient flexibility to permit configuring of the element from the first to the second configuration, to form the liner of the conical shaped charge described here.

The element and therefore the liner 32, and the explosive element 34, may be formed of materials which adhere to each other upon contact, without a separate adhesive; alternatively, an adhesive may be used to adhere the explosive element 34 and the liner 32.

Figure 4A:
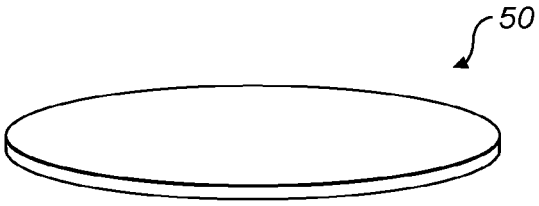
FIGS. 4*a*, 4*b* and 4*c* show schematically steps of a method according to an embodiment of the disclosure.
Figure 4B:
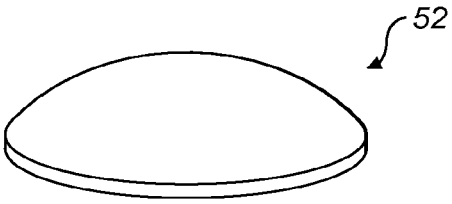
Figure 4C:
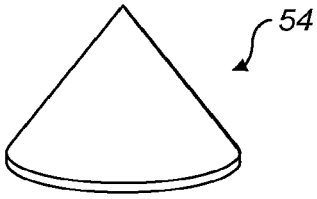

FIGS. 4*a*, 4*b* and 4*c* illustrate an example of preparing the liner from the element, in view of the flexible properties of the element. The element may first be provided in the first configuration, for example a disc shape 50. Next, as illustrated in FIG. 4*b*, the disc shaped element may be changed to an intermediate configuration 52 where one side of the element is concave and the opposite side is convex. In a next step, illustrated in FIG. 4*c*, the shape of the element is further changed to form the second configuration, which in this case is a conical-shaped liner configuration 54 such as that illustrated in FIG. 3. The changing of configuration of the element may be performed by a human user molding the element with their hands and/or appropriate tools, for example a cone template. In envisaged embodiments, the material of the element may be sufficiently rigid so that the element holds the configuration it is provided with, so the element for example can support itself in the second configuration when stood on a surface, for example by placing its circular edge on a target object. In other embodiments, the configuration of the element may be held by for example explosive material applied thereto, the explosive material being sufficiently rigid to hold the form of the explosive element and the configuration of the element also.

Given the flexible properties of the element material, the disc shaped element could be provided by changing the element from a packed, for example a rolled configuration for easy storage and with low bulk, to the first configuration, for example by unrolling the rolled configuration to provide the first configuration, when needed. Other configurations for packing the first configuration of the element are envisaged, for example folded configurations. A protective element may cover a first part of the element. The protective element may prevent the first part from touching a second part of the element, and may be for example non-stick paper, or equivalent. For example, the protective element may be placed on one or two sides of the element when in the rolled, packed configuration, to avoid the element liner sticking to itself when rolled and/or to reduce contamination of the element material. The protective element may be removed once the element is unrolled to the first configuration, or when the element is configured in the second configuration.

The second configuration of the element may be suitable for the application of an explosive material thereto, to assemble a shaped charge comprising the liner, being the element in the second configuration, and an explosive element comprising the explosive material. Thus, once the liner is formed in the conical second configuration, an explosive material may be applied to the outer surface of the liner 32, i.e. the surface facing away from the face 40, to form the explosive element 34 and thus the conical shaped charge illustrated in FIG. 3. The material of the explosive element may be suitably malleable so it can be formed by a person into the desired conical shape for application to the liner. The face 40 of the now assembled conical shaped charge may then be applied to a target object, and the explosive element detonated using for example an electrical detonator (not shown). Upon detonation, as illustrated in FIG. 3, the liner 32 is projected towards the target object as a jet 44 originating from the apex of the liner 32, and travelling along a cone axis CA through the space 42, towards the target object.

Figure 5:
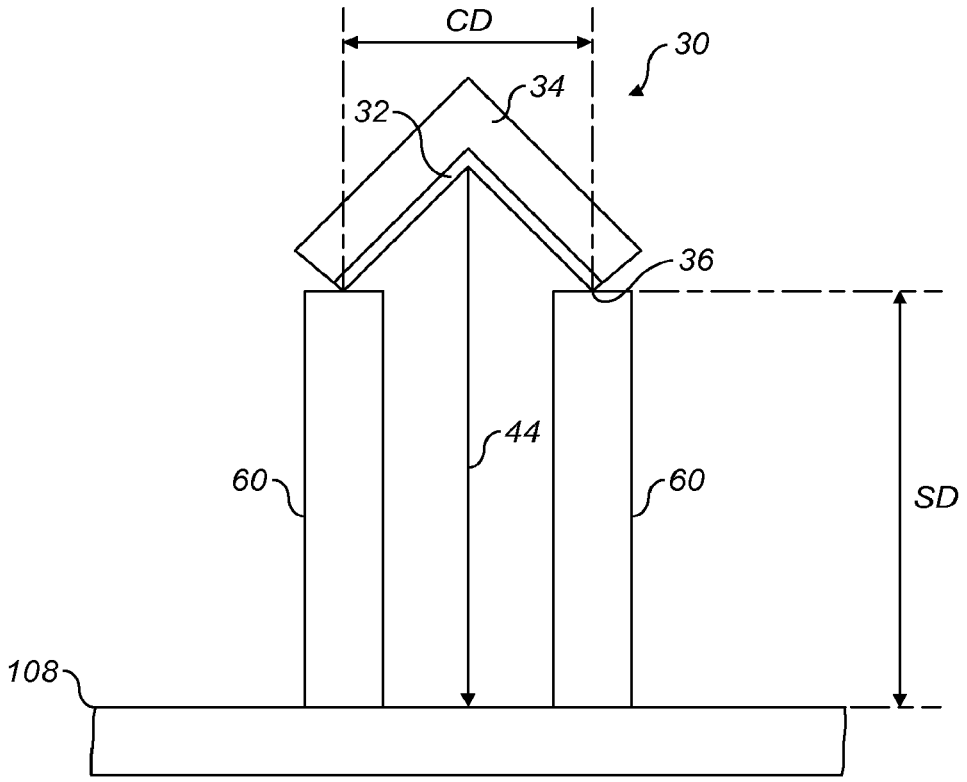
FIGS. 5 to 8 show schematically embodiments of the disclosure.
Figure 6:
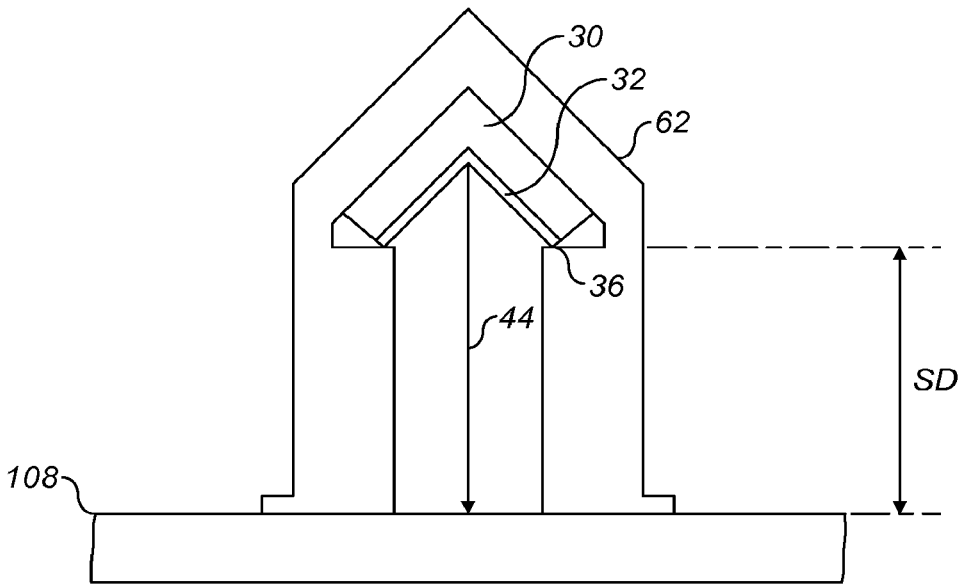
Figure 7:
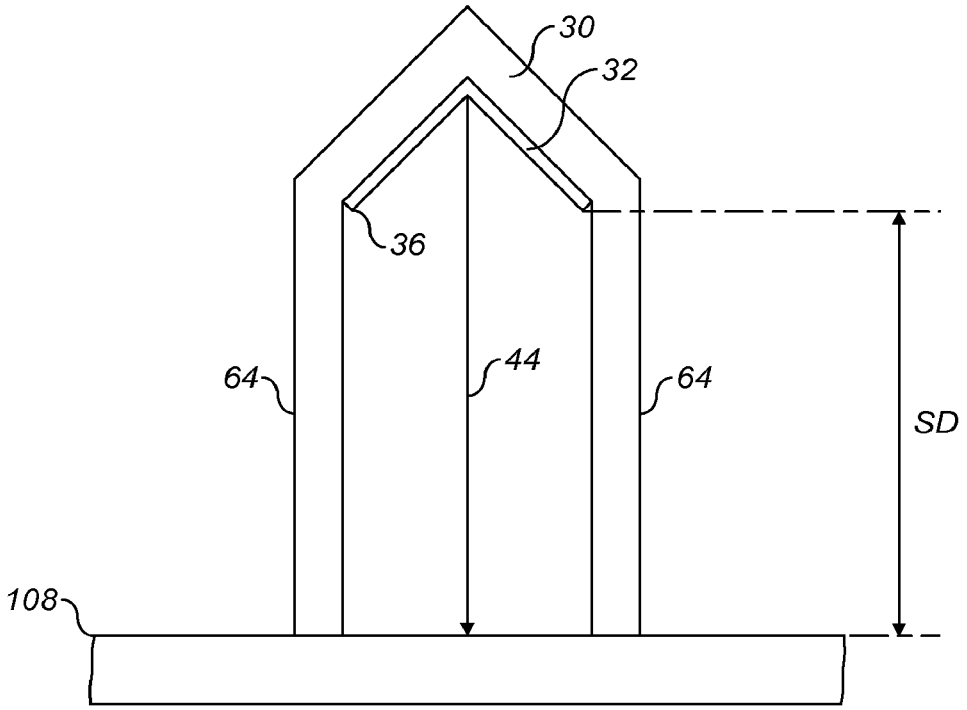
Figure 8:
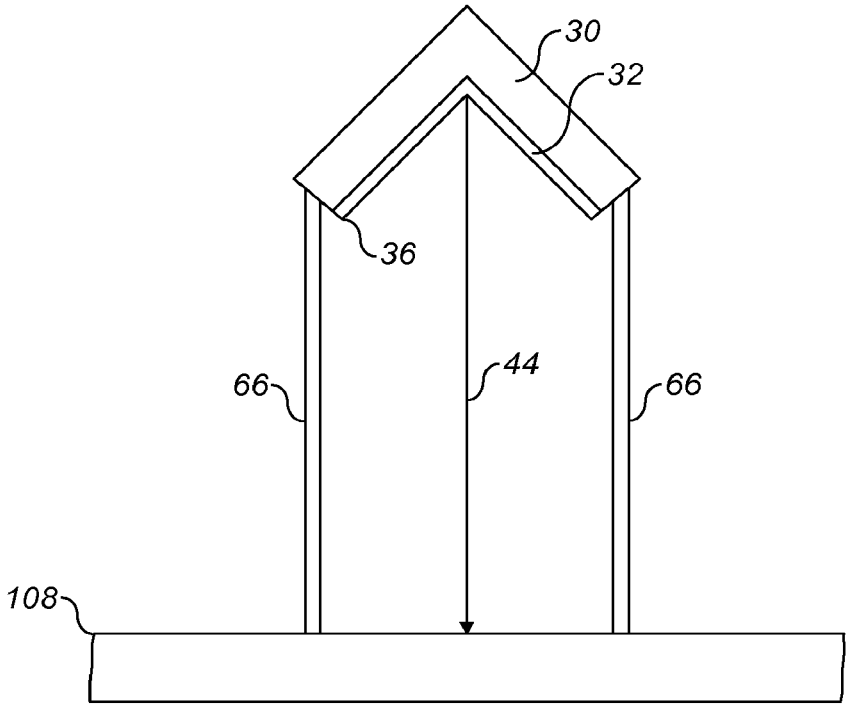

FIG. 3 shows the circular edge of the conical shaped charge being applied 124 directly to the target object 108, thus giving a zero stand-off distance. In further embodiments, in advance of detonating the conical shaped charge, the assembled liner and explosive element may be arranged with a stand-off distance between the face and the target object. This may be achieved using at least one structure, or material for forming at least one structure, for providing a desired stand-off distance; referring to FIGS. 5 and 6, this may be done by placing the circular edge of the conical shaped charge on blocks 60, or in a recess of a block structure 62, for example, arranged on the target object and which does not obstruct the path of the jet 44 upon detonation. The blocks may have dimensions to give a desired stand-off distance SD, for example greater than between three and six times the diameter CD of the cone. The blocks may be formed of rubber, or any suitable material. It is envisaged that the blocks may be formed of a light weight material, and may be constructed to have a compact or compactable construction, so they can be easily carried by a person. In other embodiments, for example as illustrated in FIG. 7, it is envisaged that the explosive element could be formed to provide legs 64, for example, which extend beyond the circular edge and are used to stand the conical shaped charge on the target object with a desired stand-off distance SD. In other embodiments, as illustrated in FIG. 8, instead of forming such legs using explosive material, separate leg elements 66 could be inserted into the explosive material and spaced appropriately around the circular edge of the conical shaped charge, to provide a desired stand-off distance. Such leg elements could be rods, sticks or tubes, for example.

Further examples of the element for the liner of the conical shaped charge are envisaged. For example, the material of the element may, in addition to being flexible, have elastic properties. This may be achieved by including an elastic polymer, i.e. an elastomer, for example platinum cured silicone, in the element material, for example the polymer matrix of the material of the present disclosure; in such an embodiment, the material may comprise 88 wt % of copper particles, for example particles in accordance with those described above, and 12 wt % of the elastomer. In further embodiments, different proportions are envisaged, and the material may also comprise other additives such as any of the constituents of the material described previously. Accordingly, the element can be given a memory for the second configuration, for example. With this memory and the flexible properties, the element may be stored in a rolled up configuration, for example, and then when required for use, unrolled, thus enabling the element itself to change its configuration to adopt the memorized second configuration. Thus, changing the configuration of the element to the desired conical configuration may be quick, the desired conical configuration being reliably obtained with desired geometry for producing an effective jet for penetrating the target object upon detonation.

Figure 9:
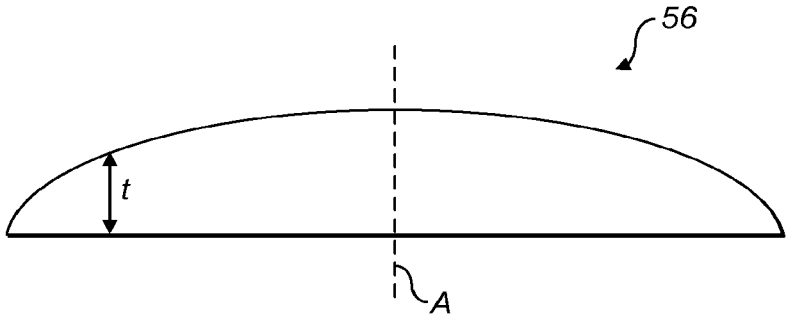
FIG. 9 shows a cross section of a liner according to an embodiment of the disclosure.

The disc shaped element, illustrated in FIG. 4*a*, may have a uniform thickness. In other examples, a disc shaped element 56, for molding to a conical configuration, may have a thickness t profile as illustrated in FIG. 9, the thickness being taken in a direction of a central axis A and increasing towards the central axis A. This thickness profile takes into account stretching of the material when being molded to form a conical shape. Thus, as the material at the central axis A will stretch the most when being molded from the disc shape to form a cone, more material is provided at the central axis. Therefore, with an appropriate thickness profile, the resulting conical liner has a uniform thickness T.

In further examples, the shape of the element configured in the second configuration may be different from that described previously; for example, the second configuration may be frustoconical instead of conical, with the explosive element configuration described using FIG. 3 modified accordingly. Further, it is envisaged that the shape of the conical or frustoconical liner may not be perfectly conical or frustoconical, respectively. For example, the liner may be substantially conical, or substantially frustoconical, meaning the liner has a configuration suitable for providing the function of a conical liner or frustoconical liner, respectively, when assembled in a shaped charge. The form and power of the jet upon detonation may be controlled by selecting appropriate geometry of the liner, for example the apex angle □ and liner thickness T.

In a further example, it is envisaged that the element may be provided for assembling other types of shaped charge, for example a linear shaped charge. Similarly, as for the element for the conical liner example described above, such an element may be stored in a rolled form, and can be unrolled and then molded to form a liner with a configuration suitable for the desired shaped charge, for example, the V-shaped configuration of the liner described in relation to FIG. 1 above. The element may be formed of the material described for the element for the conical liner, with appropriate flexible and optionally elastic properties. Thus, the element may have a memory for the V-shaped configuration, providing quick and accurate assembly of a linear shaped charge. Similarly as for the conical shaped charge described previously, an explosive element may be applied to the outer surface of the element in the second configuration, to assemble a linear shaped charge. In this example, a casing and/or filling material, such as those described above in relation to the linear shaped charge of FIG. 1, may not be provided.

In further embodiments an element configurable between a first configuration and a second configuration, for assembling a shaped charge, is envisaged for other types of shaped charge, for example a parabolic, hemispheric or progressive shaped charge. A structure or material for forming a structure, for providing a desired stand-off distance, may be used for such other types of charge; for example, similar structures to those described using FIGS. 5 to 8, may be used. Depending on the type of shaped charge, the stand-off distance may be appropriately selected. For example, different to a conical shaped charge, a linear shaped charge may have a stand-off distance of less than the throat width of the liner, the term throat width being a term used for linear shaped charges and equivalent to the conical diameter measurement CD described above for conical shaped charges.

Further, the first configuration may be different from those described above, depending on the shape of liner to be formed. Further still, different first configurations are envisaged which may be changed to the same second configuration. In the example of the conical shaped liner, instead of a disc shape, the first configuration may be a disc shape with a circle sector removed; thus the element may be molded to join the two sides of the sector together, thus forming a cone.

In a further example, a kit for assembling a shaped charge, such as the conical shaped charge described above, is envisaged, the kit comprising an element for forming a liner of a shaped charge, in accordance with such elements described above for example, and an explosive material suitable for application to the liner in the second configuration, to form a shaped charge. The kit may further comprise at least one structure, or material for forming at least one structure, for providing a desired stand-off distance between the face of the shaped charge and the target object.

Numerical ranges are given above. Although minimum and maximum values of such ranges are given, each numerical value between the minimum and maximum values, including rational numbers, should be understood to be explicitly disclosed herein. For example, a range of 1 to 10 wt % discloses also numerical values of for example 3 wt %, 6.5 wt %, 8.58 wt %.

It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the disclosure, which is defined in the accompanying claims.

What is claimed is:

1. A method of at least partly manufacturing a linear shaped charge, comprising:

coating each of a plurality of metal particles with a non-metal, to form a plurality of coated spherical particles;

mixing, without a solvent, the plurality of coated spherical particles with a polymer binder and at least one of:

a filler, a dry lubricant, or a wet lubricant, until a flexible material is formed with the plurality of coated spherical particles dispersed homogeneously in the polymer binder and the flexible material has a mass of at least 5,700 kg per cubic metre volume of the flexible material;

at least partly forming a liner for the linear shaped charge from the flexible material and with a shape comprising:

a first longitudinal surface with: a first V-shaped cross-section, a first longitudinal edge and a second longitudinal edge, a second longitudinal surface with: a second V-shaped cross-section, a third longitudinal edge and a fourth longitudinal edge, a third longitudinal surface between the first longitudinal edge and the third longitudinal edge, and a fourth longitudinal surface between the second longitudinal edge and the fourth longitudinal edge;

applying a fifth longitudinal surface of an explosive element to the first longitudinal surface;

forming a filling material with a longitudinal surface having a W-shaped cross-section for applying to the second longitudinal surface, the third longitudinal surface and the fourth longitudinal surface; and applying the filling material to each of the second longitudinal surface, the third longitudinal surface and the fourth longitudinal surface of the liner.

2. The method of claim 1, wherein before the coating each of the plurality of metal particles with a non-metal, at least some of the plurality of metal particles are irregular in shape, the method comprising:

after the coating each of the plurality of metal particles with the non-metal, rounding an outer surface of the non-metal, to form the plurality of coated spherical particles.

3. The method of claim 1, the explosive element comprising a sixth longitudinal surface with a third V-shaped cross-section, the method comprising:

applying a casing to the sixth longitudinal surface of the explosive element.

4. The method of claim 3, comprising:

applying the filling material to each of a seventh longitudinal surface and an eighth longitudinal surface of the explosive element.

5. The method of claim 3, wherein a seventh longitudinal surface of the explosive element is co-planar with the third longitudinal surface, and an eighth longitudinal surface of the explosive element is co-planar with the fourth longitudinal surface.

6. The method of claim 5, the filling material having a shape such that, with the filling material applied to each of the second longitudinal surface, the third longitudinal surface and the fourth longitudinal surface of the liner, a first portion of the filling material is:

between the third longitudinal surface of the liner and the casing, and between the seventh longitudinal surface of the explosive element and the casing; and a second portion of the filling material is:

between the fourth longitudinal surface of the liner and the casing, and between the eighth longitudinal surface of the explosive element and the casing.

7. The method of claim 6, the filling material having a shape such that, with the filling material applied to each of the second longitudinal surface, the third longitudinal surface and the fourth longitudinal surface of the liner, there is:

a first void between part of the seventh longitudinal surface and the casing; and a second void between part of the eighth longitudinal surface and the casing.

8. The method of claim 3, the filling material having a shape such that, with the filling material applied to each of the second longitudinal surface, the third longitudinal surface and the fourth longitudinal surface of the liner, a first portion of the filling material is between the third longitudinal surface of the liner and the casing, and a second portion of the filling material is between the fourth longitudinal surface of the liner and the casing.

9. The method of claim 1, wherein the at least partly forming comprises forming a section of the flexible material with sectional dimensions for then forming the liner for the linear shaped charge.

10. The method of claim 1, wherein the at least partly forming comprises at least one of:

calendering and slitting the flexible material to form a section of the flexible material with sectional dimensions for then forming the liner for the linear shaped charge; or extruding the flexible material with a cross sectional shape for the liner for the linear shaped charge.

11. The method of claim 1, comprising masticating the polymer binder and at least one of the filler or the dry lubricant, before the mixing.

12. The method of claim 1, wherein the plurality of metal particles comprises metal particles with a diameter of 10 micro-metres or less.

13. The method of claim 1, wherein at least 20 wt % of the plurality of metal particles comprises metal particles with a diameter of 10 micro-metres or less.

14. The method of claim 1, wherein 33 wt % or less of the plurality of metal particles comprises metal particles with a diameter of 10 micro-metres or less.

15. The method of claim 1, wherein the plurality of coated spherical metal particles comprises:

0.5 to 1 wt % particles with a diameter of 70 micro-metres;

4 to 5 wt % particles with a diameter of 60 micro-metres;

20 to 30 wt % particles with a diameter of 50 micro-metres;

25 to 35 wt % particles with a diameter of 40 micro-metres;

20 to 30 wt % particles with a diameter of 10 micro-metres; and less than 3 wt % particles with a diameter of less than 10 micro-metres.

16. The method of claim 1, wherein the filler comprises at least one of cyanuric acid, melamine, or polytetrafluoroethylene.

17. The method of claim 1, wherein the non-metal comprises polytetrafluoroethylene.

18. The method of claim 1, wherein each of the plurality of metal particles comprises at least one of: copper (Cu), tungsten (W), molybdenum (Mb), aluminium (Al), uranium (U), tantalum (Ta), lead (Pb), tin (Sn), cadmium (Cd), cobalt (Co), magnesium (Mg), titanium (Ti), zinc (Zn), zirconium (Zr), beryllium (Be), nickel (Ni), silver (Ag), gold (Au), or platinum (Pt).

19. The method of claim 1, wherein the polymer binder comprises at least one of polybutene, polyisobutylene, silicone, latex, alginate copolymer or methacrylate resin;

the dry lubricant comprises at least one of boron nitride or polytetrafluoroethylene; and the wet lubricant comprises at least one of di-2-ethylhexyl sebacate, di-n-octyl phthalate or vegetable oil.

20. A method of at least partly manufacturing a linear shaped charge, comprising:

coating each of a plurality of metal particles with a non-metal, to form a plurality of coated spherical particles;

mixing, without a solvent, the plurality of coated spherical particles with a polymer binder and at least one of:

a filler, a dry lubricant, or a wet lubricant, until a flexible material is formed with the plurality of coated spherical particles dispersed homogeneously in the polymer binder and the flexible material has a mass of at least 5,700 kg per cubic metre volume of the flexible material;

at least partly forming a liner for the linear shaped charge from the flexible material and with a shape comprising:

a first longitudinal surface with: a first V-shaped cross-section, a first longitudinal edge and a second longitudinal edge, a second longitudinal surface with: a second V-shaped cross-section, a third longitudinal edge and a fourth longitudinal edge, a third longitudinal surface between the first longitudinal edge and the third longitudinal edge, and a fourth longitudinal surface between the second longitudinal edge and the fourth longitudinal edge;

applying a fifth longitudinal surface of an explosive element to the first longitudinal surface, the explosive element comprising a sixth longitudinal surface with a third V-shaped cross-section, a seventh longitudinal surface and an eighth longitudinal surface;

applying a casing to the sixth longitudinal surface of the explosive element; and applying a filling material to each of the second longitudinal surface, the third longitudinal surface and the fourth longitudinal surface of the liner, the filling material having a shape such that, with the filling material applied to each of the second longitudinal surface, the third longitudinal surface and the fourth longitudinal surface of the liner, there is:

a first void between part of the seventh longitudinal surface and the casing; and a second void between part of the eighth longitudinal surface and the casing.

21. The method of claim 20, wherein the seventh longitudinal surface of the explosive element is co-planar with the third longitudinal surface, and the eighth longitudinal surface of the explosive element is co-planar with the fourth longitudinal surface.

22. The method of claim 21, the filling material having a shape such that, with the filling material applied to each of the second longitudinal surface, the third longitudinal surface and the fourth longitudinal surface of the liner, a first portion of the filling material is:

between the third longitudinal surface of the liner and the casing, and between the seventh longitudinal surface of the explosive element and the casing; and a second portion of the filling material is:

between the fourth longitudinal surface of the liner and the casing, and between the eighth longitudinal surface of the explosive element and the casing.

* * * * *